US011208807B1

(12) United States Patent
Lopes

(10) Patent No.: US 11,208,807 B1
(45) Date of Patent: Dec. 28, 2021

(54) CONSTRUCTIVE ARRANGEMENT INTRODUCED IN MODULE FOR PANELS INTENDED FOR THE CONSTRUCTION OF PREFABRICATED BUILDINGS

(71) Applicant: Luciano Simoes Lopes, Porto Alegre (BR)

(72) Inventor: Luciano Simoes Lopes, Porto Alegre (BR)

( * ) Notice: Subject to any disclaimer, the term of this patent is extended or adjusted under 35 U.S.C. 154(b) by 0 days.

(21) Appl. No.: 17/065,517

(22) Filed: Oct. 8, 2020

(51) Int. Cl.
*E04C 2/38* (2006.01)
*E04B 1/08* (2006.01)

(52) U.S. Cl.
CPC . *E04C 2/38* (2013.01); *E04B 1/08* (2013.01)

(58) Field of Classification Search
CPC ..... E04C 2/38; E04B 1/08
See application file for complete search history.

(56) References Cited

U.S. PATENT DOCUMENTS 1,536,977 A * 5/1925 Skipworth ..... E04B 1/08 52/11
2,052,346 A * 8/1936 Garrett ..... E04B 2/72 52/274
3,568,388 A * 3/1971 Flachbarth ..... E04B 2/72 52/588.1
5,979,136 A * 11/1999 Marschak ..... E04C 2/08 52/462
6,568,144 B2 * 5/2003 Meredith ..... E04B 1/08 52/300
8,146,314 B2 * 4/2012 Nguyen ..... E04B 1/08 52/478

FOREIGN PATENT DOCUMENTS

FR 1238546 A * 8/1960 ..... E04B 2/58
GB 191503674 A * 4/1916 ..... E04B 1/08

* cited by examiner

*Primary Examiner* — Adriana Figueroa
(74) *Attorney, Agent, or Firm* — Ruben Alcoba, Esq.

(57) ABSTRACT

A constructive arrangement introduced in module for panels intended to the construction of prefabricated buildings. The modules for the construction of prefabricated buildings, having the objective of facilitating the handling and portability of each module; as well as increasing the structural strength of the module, and, consequently, of the panels composed of such modules. The constructive arrangement comprises of a module consisting of a galvanized metal sheet, folded at the ends, configuring characteristic profiles in the shape of an open socket, and a closed socket, capable of configuring panels by conjoining the modules screwed together and grouped by the upper and lower profiles, characterized by having stiffening ribs near the central portion of the sheets, and stiffening ribs near the profiles.

1 Claim, 5 Drawing Sheets

CONSTRUCTIVE ARRANGEMENT INTRODUCED IN MODULE FOR PANELS INTENDED FOR THE CONSTRUCTION OF PREFABRICATED BUILDINGS

RELATED APPLICATIONS

This application claim priority of Brazilian Patent Application number BR 20 2020 016984 5, that was filed on Aug. 20, 2020, which was titled Disposicao Construtiva Intrduzida Em Modulo Para Paines Destinados A Construcao De Dificacoes Pre-Fabricadas.

TECHNICAL FIELD

The present utility model refers to the technological sector of wall structures for buildings, more specifically, modules intended to the construction of panels for the construction of prefabricated buildings, having the objective of facilitating the handling and portability of each module; as well as increasing the structural strength of the module, and, consequently, of the panels composed of such modules.

STATE OF THE ART

It is known, in the state of the art, that currently, the existing models on the market have specific characteristics for the assembly of panels, however, they lack structural rigidity, suffering problems with transport damage, making portability in the job site difficult; in addition to causing handling problems due to the modules buckling easily; and, the lower stiffness of the panels formed by the modules.

In the current state of the art, several models of modules intended to the manufacture of panels for the construction of buildings are known, one among which is disclosed in patent document PI 0505875-9, entitled "Structural Module of Multiple Uses", which describes a complete structural module (1) and which incorporates its own specific structure of a modular type prefabricated in the form of a sandwich, containing two outer flat layers (2), customized, integrated and symmetrically arranged between each other, of general shapes varying according to the application and arranged in parallel and symmetrically spaced from each other, a set of inner flat layers (3) over the entire length of the inner faces of the two outer flat layers (2); and a set of intermediate geometric layers (4) of general honeycomb shapes with varied geometric profiles.

Also in the current state of the art, is disclosed patent document PI 8904075-9, authored by the applicant himself, entitled "manufacturing process for a construction board, and the resulting product", which describes galvanized sheets (1), folded at the ends (2), so as to form characteristic profiles (3), receiving an internal plaster covering (4), provided with an adequate covering (5), external covering in plywood (6), covered by PVC or vinyl profiles (7) and a suitable thermal insulation (7A), which have a line of orifices properly arranged (8).

The prior art does not offer a solution to the aforementioned problems, since the prior art discloses modules that buckle, which makes the handling and portability of the modules difficult; in addition, the structural strength of the panels is limited to the configuration of the modules, and does not improve the strength of the building in which they are applied.

NOVELTY AND OBJECTIVES OF THE UTILITY MODEL

Thus, the objective of the present utility model is to characterize a constructive arrangement in a module for panels intended for the construction of prefabricated buildings that will allow greater ease of handling and portability by the workers, expediting the building construction process; as well as, reducing the risk of accidents in the process; in addition to increasing the structural strength of the modules, and, consequently, of the panels composed of such modules.

ADVANTAGES OF THE UTILITY MODEL

The advantages resulting from the present model are evident and, among many others, the following can be mentioned: it allows greater ease of handling and portability by the workers, expediting the building construction process; it has higher structural rigidity and lower risk of damage to the modules in transport, allowing more stacking, which reduces the transport costs, due to a better use of space; it reduces the risk of accidents on the job site, due to the lower buckling of each module; it increases the structural strength of the modules, and, consequently, of the panels composed of such modules.

BRIEF DESCRIPTION OF THE ATTACHED DRAWINGS

For a more complete understanding of the present invention and its features and advantages, reference is now made to the following description, taken in conjunction with the accompanying drawings, in which.

Figure 1:
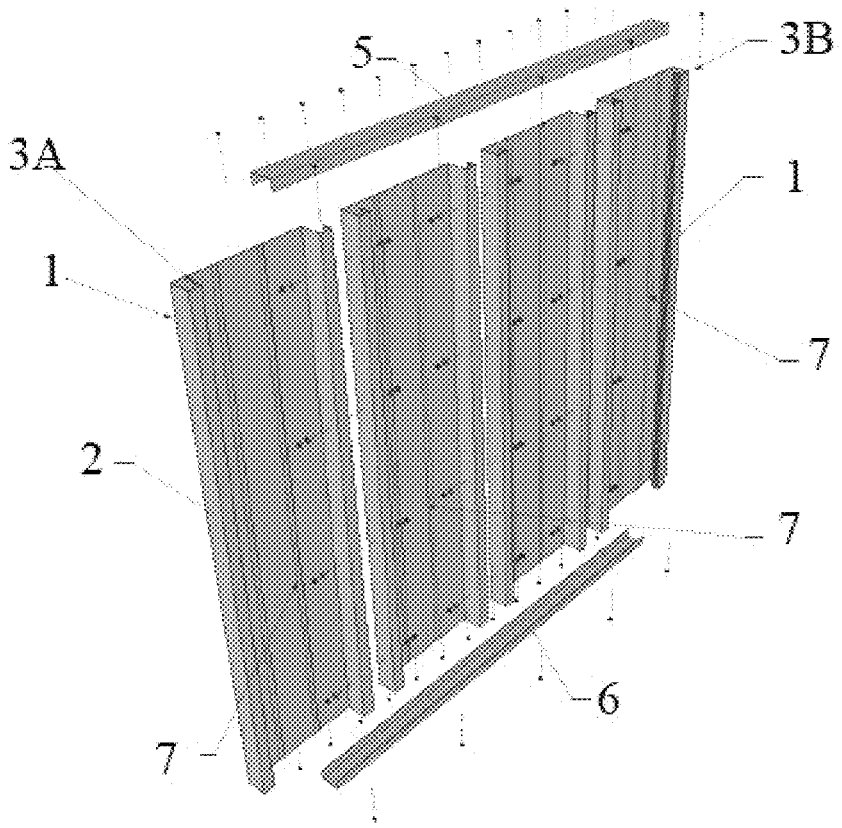
FIG. 1 is a perspective view of a set of modules (1) with the idealized configuration, which are ready to be assembled and tied by the upper (5) and lower (6) profiles to form the panels (4)
Figure 2:
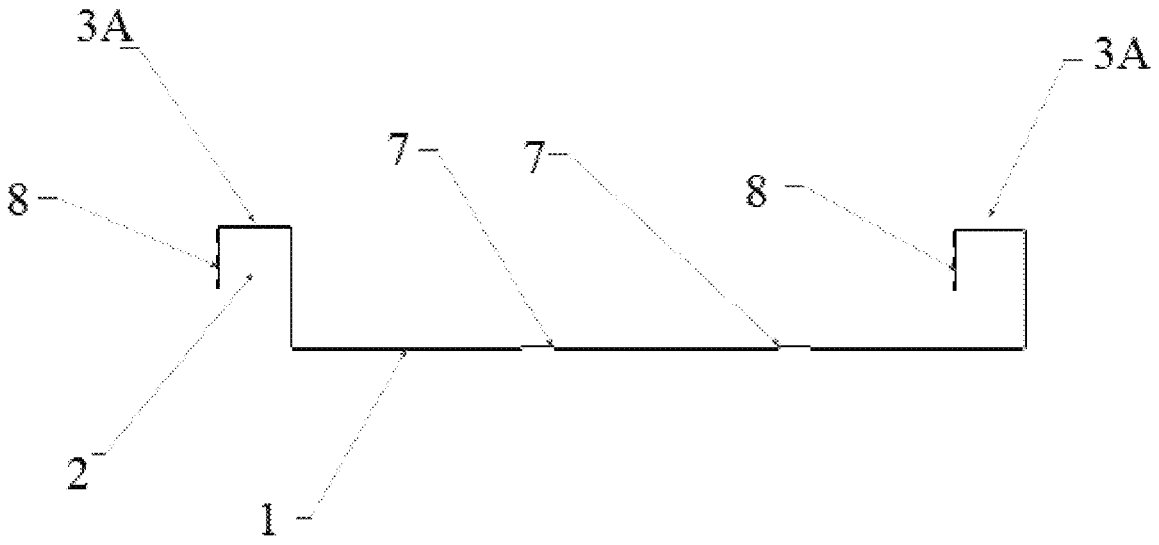
FIG. 2 is a view of the module (1) with the open profile (3A), together with the respective perspective.
Figure 3:
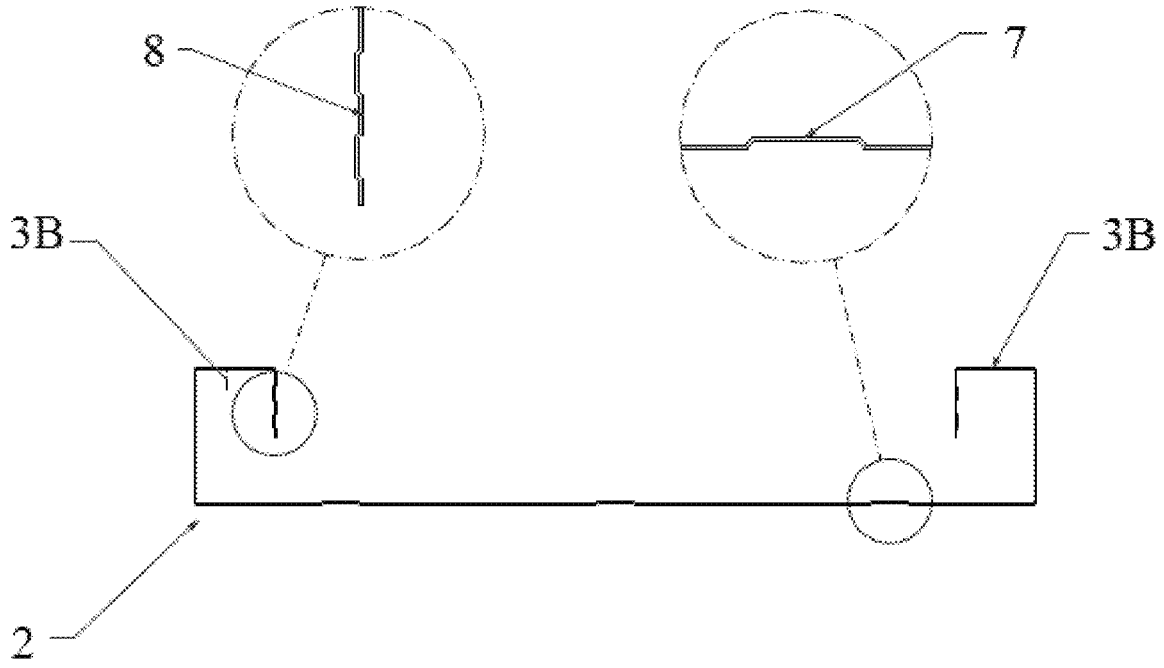
FIG. 3 is a view of the module (1) with the closed profile (3B), in which reference is made to the details of the stiffening ribs (8) existing in the fitting grooves (2), and, near the central area of each module (1), together with the respective perspective.
Figure 4:
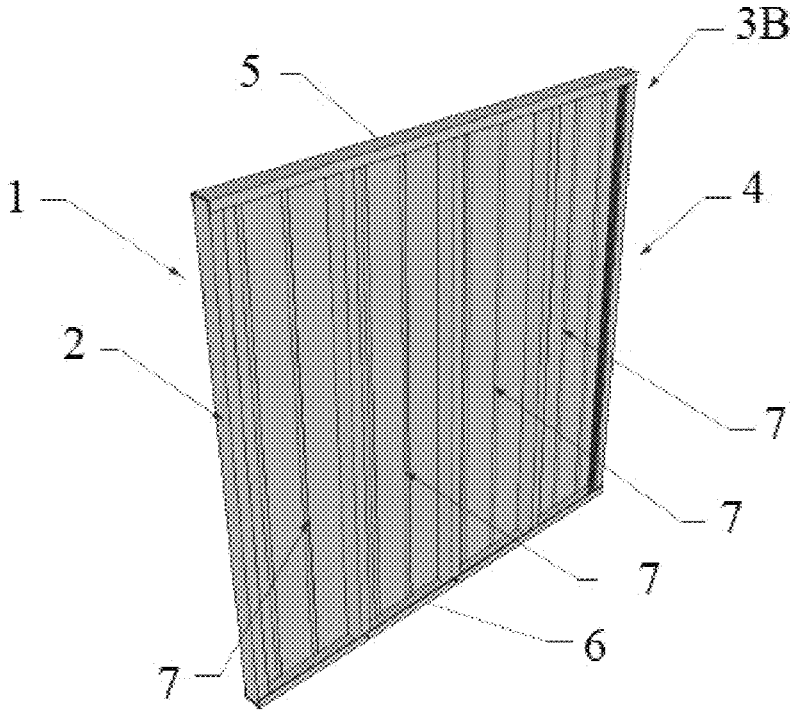
FIG. 4 is a perspective view of a set of modules (1) with the idealized configuration, which are already properly assembled and tied by the upper (5) and lower (6) profiles.
Figure 5:
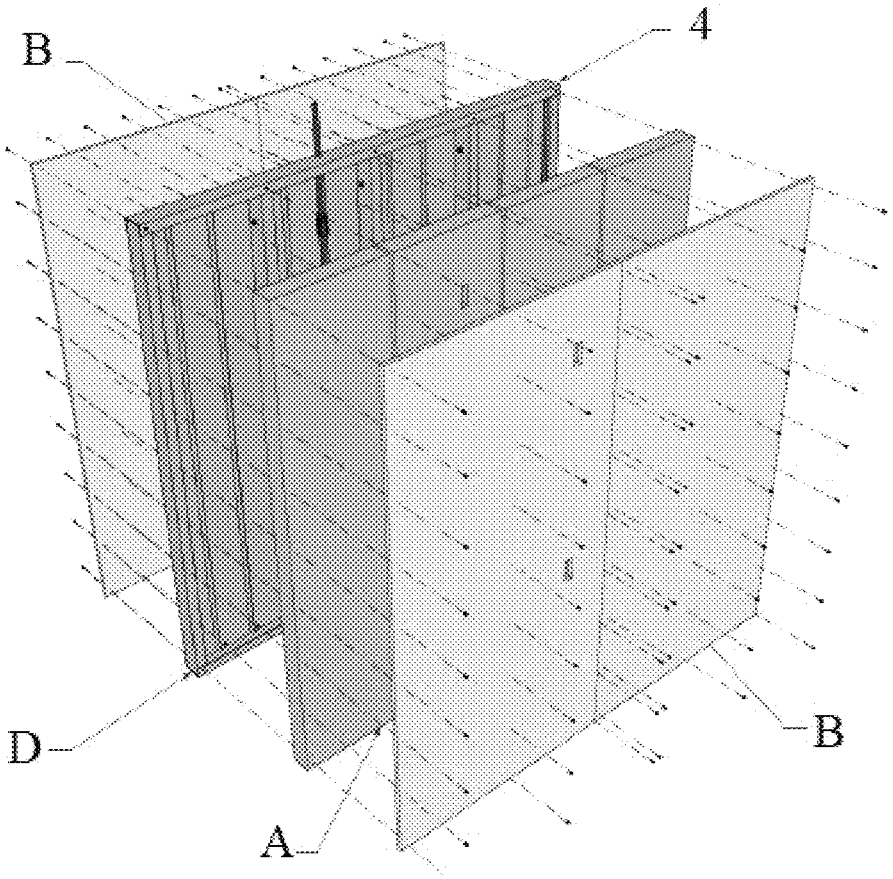
Figure 6:
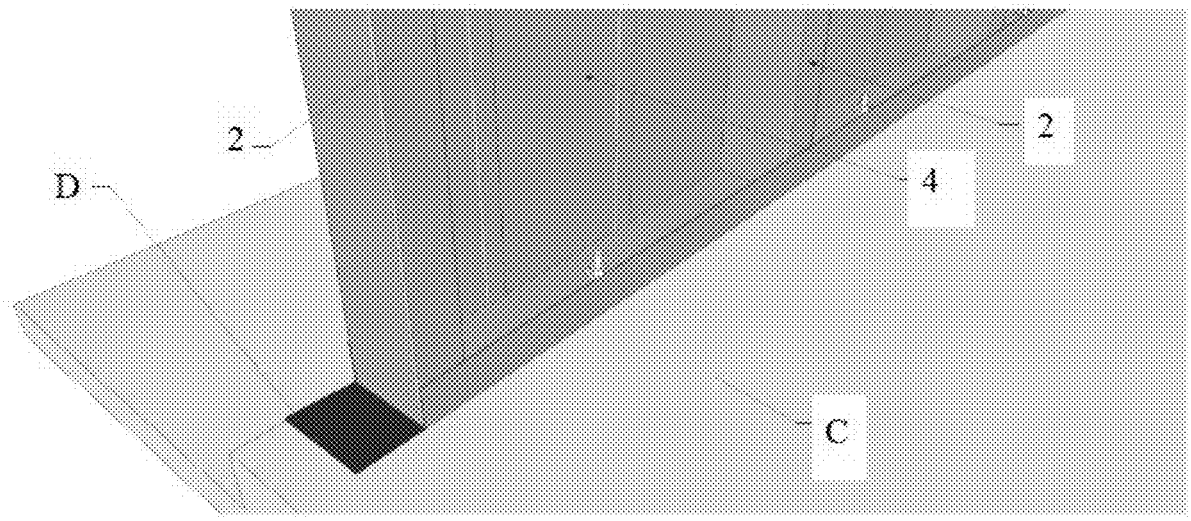

FIG. 5 is a perspective view of a set of modules (1) assembled and tied by the upper (5) and lower (6) profiles, configuring the panels (4), which are being covered by a thermo-acoustic insulating element (A) and the internal and external coverings (B), so that they are ready to be used in the building; and FIG. 6 is a detailed view of a set of modules (1) assembled and tied by the upper (5) and lower (6) profiles, configuring the panels (4), which are ready to receive a waterproofing bituminous foam (C) and fastened to the slab (D).

Although this model is described in conjunction with the presented preferred embodiment, it is understood that its constructive characteristics are not limited to this solution.

On the contrary, it is proposed to cover all alternatives, variations, modifications and equivalent forms that may be included within the scope and spirit of this utility model.

DETAILED DESCRIPTION OF THE UTILITY MODEL

As can be inferred by the analysis of the attached figures, the constructive arrangement in module for panels intended to the construction of prefabricated buildings, according to what is recommended by the present utility model, comprises a module (1) consisting of a galvanized metal a closed socket (3B), capable of configuring panels (4) by the conjunction of modules (1) screwed together and grouped by the upper (5) and lower (6) profiles, characterized by having linear vertical ribs (7) near the central area of the sheets (1), and stiffening ribs (8) near the profiles (3A) and (3B).

In an embodiment of the present invention, a plurality of modules 1, the modules are folded at their ends 2, a first set of the modules define a pair of open sockets 3A and a second set of the modules define a pair of closed sockets 3B, at least three of the open socket 3A modules are placed side by side to each other and a closed socket 3B module is placed adjacent to one of the open socket 3A modules, the modules 1 are secured to each other using a plurality of screws and the modules 1 are further secured together to each other by placing the modules 1 within an upper track 5 and a lower track 6, each module 1 defines a linear vertical rib 7, and the open socket modules 3A and closed socket 3B modules define stiffening ribs 8.

The panels (4) are capable of receiving a thermo-acoustic insulating element (A) on the inner face, and an internal and external covering (B); furthermore, said panels (4) can be positioned on a sill plate, slab or floor (C) with application of a bituminous waterproofing foam (D).

The functionality of the constructive arrangement in module for panels intended to the construction of prefabricated buildings is very simple, and can be described as follows: the stiffening ribs (8) existing in the central area of the modules (1), and, near the profiles (3A) and (3B) significantly reduce buckling and increase the stiffness of the modules (1), which allows more stacking, without risking damage, reducing the transport cost due to a better use of space; in addition to facilitating handling, ensuring greater portability, and ease of assembly of the building, reducing the work time and risk of accidents; as well as, ensuring greater safety for workers.

After assembly of the building, already having a thermo-acoustic insulation (A) on the internal side, and the internal and external covering (B) of the panels (4), which will be properly screwed onto the sill plate, slab or floor (C), with application of a bituminous waterproofing foam (D), the building will be ready for painting or other finishing, if required by the builder.

In the present utility model, a constructive arrangement in module for panels intended to the construction of prefabricated buildings was presented, as can be evidenced by the analysis performed, accompanied by the attached drawings, having unprecedented characteristics in relation to everything which is known in the state of the art of this technological sector.

What is claimed is:

1. A constructive arrangement introduced in module for panels intended for the construction of prefabricated buildings, the constructive arrangement comprises:

a plurality of modules, the modules are folded at their ends defining a socket at each end, a first set of the modules define a pair of open sockets forming an open socket module and a second set of the modules define a pair of closed sockets forming a closed socket module, at least three of the open socket modules are placed side by side to each other and one of the closed socket modules is placed adjacent to one of the open socket modules, the modules are secured to each other using a plurality of screws and the modules are further secured together to each other by placing the modules within an upper and a lower track, and each of the open socket modules and the closed socket modules including a linear vertical rib in a central area, and each of the sockets of the open socket modules and each of the sockets of the closed socket modules including stiffening ribs that are configured to strengthen the sockets from folding, thereby increasing the wind tolerance that the plurality of modules can withstand between the upper and the lower tracks.

* * * * *